United States Patent [19]

Hofman

[11] 4,129,346

[45] Dec. 12, 1978

[54] PAINT AND TOOL CASE

[76] Inventor: Bernard L. Hofman, 340 Galena Pines Rd., Reno, Nev. 89511

[21] Appl. No.: 861,021

[22] Filed: Dec. 13, 1977

[51] Int. Cl.[2] ..... A47B 43/00

[52] U.S. Cl. ..... 312/324; 312/244; 312/DIG. 33

[58] Field of Search ..... 312/244, 324, 330, 345, 312/350, DIG. 33

[56] References Cited

U.S. PATENT DOCUMENTS

| | | | |
|---|---|---|---|
| 976,317 | 11/1910 | Triebling | 312/244 |
| 2,196,818 | 4/1940 | Stanton | 312/324 X |
| 2,251,753 | 8/1941 | Newton | 312/324 |
| 3,481,066 | 12/1969 | Woolworth | 312/244 X |

FOREIGN PATENT DOCUMENTS

| | | | |
|---|---|---|---|
| 327018 | 11/1919 | Fed. Rep. of Germany | 312/DIG. 33 |

*Primary Examiner*—Kenneth Downey

*Attorney, Agent, or Firm*—Clarence A. O'Brien; Harvey B. Jacobson

[57] ABSTRACT

A portable storage case particularly suitable for storing and displaying art supplies including paint containers of differing sizes, brushes, and tools. The portable case of the invention comprises three storage and display sections, a middle section having adjacent side sections pivotally hinged thereto along spaced vertical edges on one side of the middle section, the sections being latchable along the opposite sides thereof and adapted to be portable when so latched by the provision of a handle disposed on an upper portion of one of the sections. The several sections of the case are provided with vertically spaced shelf members having retaining rods spaced above and along free lateral edges thereof to retain paint containers of differing size thereon.

6 Claims, 7 Drawing Figures

PAINT AND TOOL CASE

BACKGROUND AND SUMMARY OF THE INVENTION

While portable cases have previously been provided in the art for storage of hobbyist supplies, particularly artist supplies including containers of paints, brushes, and the like, the prior art has failed to provide a conveniently portable storage case capable of ready display and convenient access to the materials stored therewithin. In particular, the present invention provides a portable case for containing hobby materials, such as paint containers, brushes, and the like, which case has three separable sections hinged along adjacent edges at adjacent side portions thereof, the case being latchable along opposite side portions to releasably lock said sections together into a volumetrically compact, easily portable structure. Shelves located in the several sections are vertically spaced by differing distances and have different depths to allow the storage and display of paint containers of differing sizes. Rod members extending horizontally between side edge portions of said sections and spaced vertically upwardly from said shelf members retain the paint or other containers on said shelf members. The present portable storage case is particularly intended to hold paint containers of differing sizes on shelf members located in the two side or outer sections of said case. The paint containers are particularly held such that the labels disposed on and/or the colors contained within said containers are readily visible without the need for handling or rearranging said containers. When the side sections are pivoted about hinges attaching said side sections to the middle section of the case, the middle section is exposed for access thereto, additional paint containers, brushes, tools, and other supplies being storable within the middle section. Cases of sufficient size can further be structured with rollers, or the like, on lower portions thereof to facilitate handling of the case. It is further apparent that the present case can be constructed of wood or other suitable material, such as a shock-resistant plastic, to provide a structure of substantial strength.

Accordingly, it is an object of the present invention to provide a storage case for artist supplies and which is conveniently portable.

It is another object of the invention to provide a portable storage case capable of containing and displaying artist supplies, including paint containers of differing dimensions.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
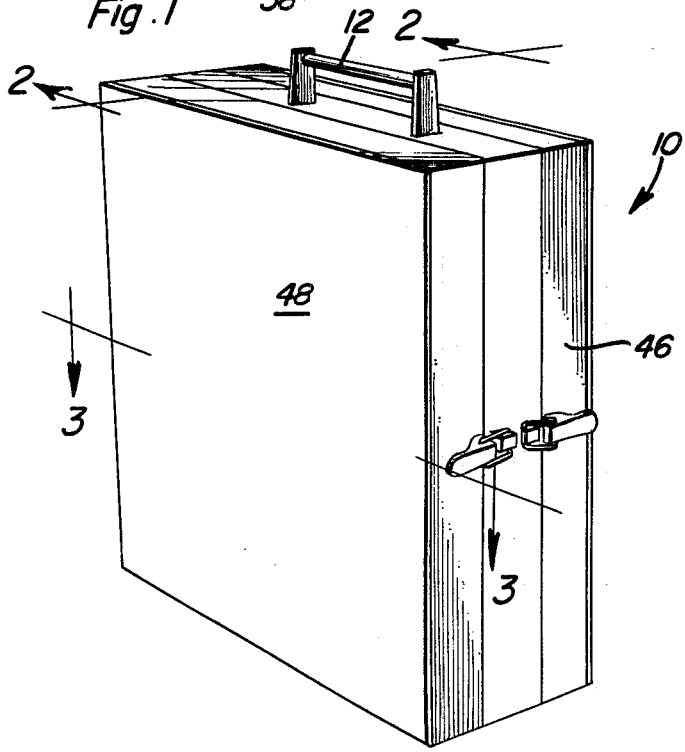
FIG. 1 is a perspective view illustrating the present portable storage case in a closed configuration such as exists when the case is configured to be carried by a user thereof or stored.
Figure 7:
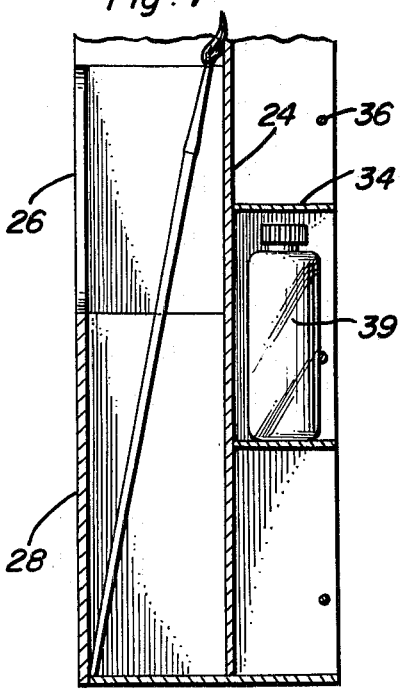
FIG. 7 is a detailed elevational view in partial section of a portion of the middle section of the present storage case.

Referring now to the drawings, a portable storage case 10 according to the invention can be particularly seen in FIG. 1 in a closed, readily transportable configuration whereby said case can be grasped through use of a handle 12 preferably attached to an upper perimetric wall 16 of a middle section 14 comprising said storage case 10. As particularly seen in FIGS. 4 through 6, the middle section 14 further comprises a lower perimetric wall 18 spaced from said upper perimetric wall 16, the walls 16 and 18 being joined at opposite ends thereof by a closed side wall and an open side wall, respectively, the walls 16, 18, 20 and 22 subatantially comprising a rectangular or square frame. The middle section 14 is further formed with an inner partition 24, which partition 24 can particularly be seen in FIGS. 2 through 4, 6 and 7, the inner partition 24 comprising a wall member disposed medially of and attached to inner surfaces of the side walls 20 and 22. The inner partition 24 further engages and is preferably attached to the lower perimetric wall 18 medially of its width, the partition 4 preferably not extending the full height of the side walls 20 and 22 but terminating immediately below an upper shelf 30 as will be described further hereinafter. As can particularly be seen in FIG. 3, the inner partition 24 divides the middle section 14 into separate volumetric portions at the lower and middle portions thereof, end box dividers 26 and interior box dividers 28 being disposed on one side of the partition 24, shallow shelf members 34 and retaining rods 36 being disposed on the opposite side of the inner partition 24 to provide shelf space for paint containers of a relatively small size. As particularly seen in FIGS. 2, 3, 6, and 7, the retaining rods 36 extend between and are mounted by the side walls 20 and 22, the retaining rods 36 being vertically spaced from the shallow shelf members 34 and acting to retain paint containers 39 of relatively small size on said shallow shelf members 34. The shallow shelf members 34 are vertically spaced from each other a distance suitable to allow the paint containers 39 to be received therebetween.

Figure 6:
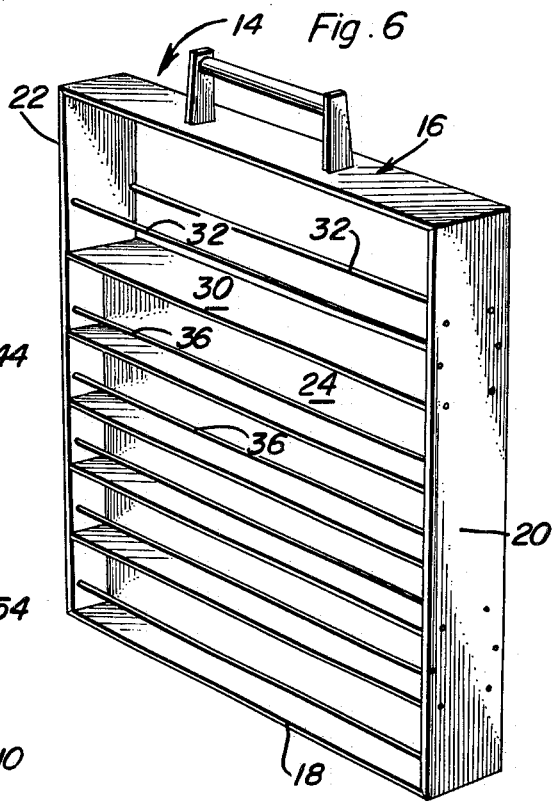
FIG. 6 is a perspective view of the middle section of the present storage case.
Figure 4:
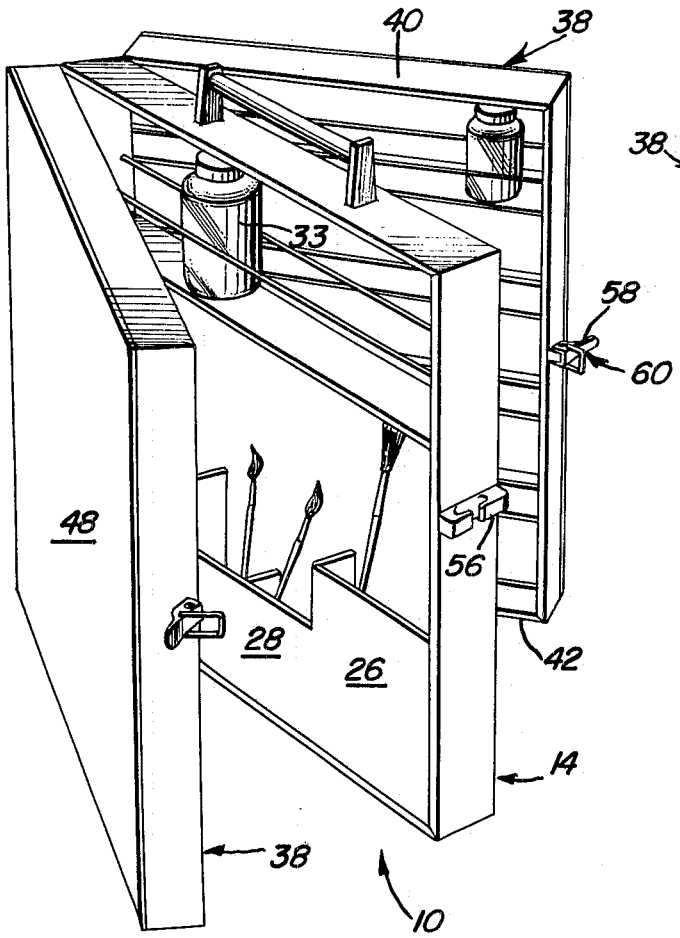
FIG. 4 is a perspective view illustrating the present storage case in the open configuration.
Figure 3:
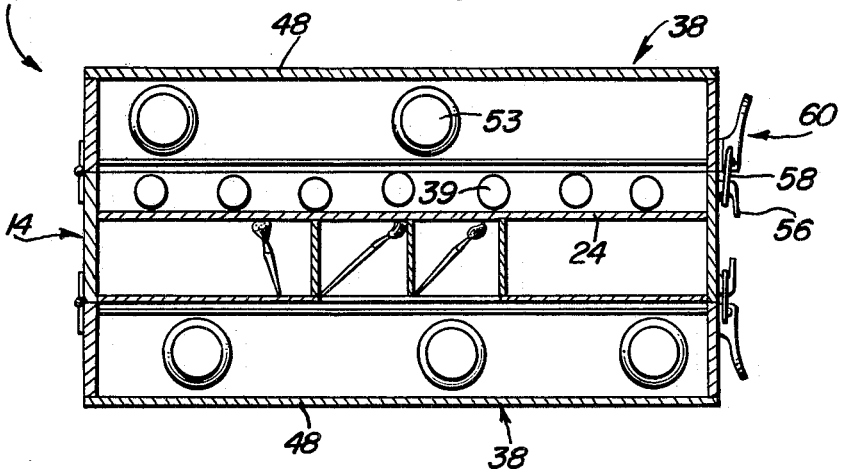
FIG. 3 is a section taken along line 3—3 of FIG. 1.

Referring now particularly to FIGS. 3, 4, and 6, the upper shelf 30 is seen to surmount the upper edge portion of the inner partition 24 and to extend between and to be mounted by the side walls 20 and 22. The upper shelf 30 provides a relatively larger shelf space for containers 33 of relatively larger size to be disposed thereon, as particularly seen in FIGS. 3 and 4. Retaining rods 32 are spaced vertically from the shelf 30 and spaced horizontally from each other, the retaining rods 32 extending between and being mounted by the side walls 20 and 22 to retain the containers 33 on the upper shelf 30. The box dividers 26 and 28 provide box-like enclosures open at one end thereof, the dividers 26 being relatively taller than the dividers 28. The dividers 26 and 28 are used to contain articles, particularly elongated articles, such as paint brushes, tools, and the like, the articles within the dividers 26 and 28 being of differing lengths and dimensions appropriate to the height of said dividers.

The storage case 10 further comprises side sections 38, which sections 38 are substantially mirror images of each other. Accordingly, a description of one of the side sections 38 will suffice for description of the other said side section. Each side section 38 comprises upper and lower perimetric walls 40 and 42, said walls 40 and 42 being joined at respective ends thereof by a closed side wall 44 and an open side wall 46 to form a frame-like structure of substantially identical lengthwise and widthwise dimensions to those of the middle section 14. Further, the depthwise dimensions of the sections 14 and 38 may also be substantially identical. Each of the sections 38 is provided with an exterior wall 48 enclosing the frame-like walls 40, 42, 44, and 46 on one side thereof, the exterior walls 48 forming spaced major wall portions of the storage case 10. As particularly seen in FIGS. 3 and 4, the side sections 38 have shelf members 50 vertically spaced therealong, the shelf members 50 extending between and being mounted by the side walls 44 and 46. Retaining rods 52 are spaced vertically from the shelf members 50 and extend between and are carried by the side walls 44 and 46, the retaining rods 52 typically retaining containers 53 of different dimensions than the containers 33 and 39. As can be particularly seen in FIG. 3, the depth of the middle section 14 can be greater than the depth of the side sections 38, when the middle section 14 is so dimensioned, the upper shelf 30 is configured to store paint containers 33 of substantially greater dimensions than the dimensions of the containers 53. As can further be seen in FIGS. 3 and 4, the containers stored on the upper shelf 30, the shallow shelf members 34 and the shelf members 50 are conveniently displayed to a user of the case 10 on opening of said case, the labels and/or colors contained within the containers being readily visible to a user without the need for handling or rearranging said containers.

Figure 5:
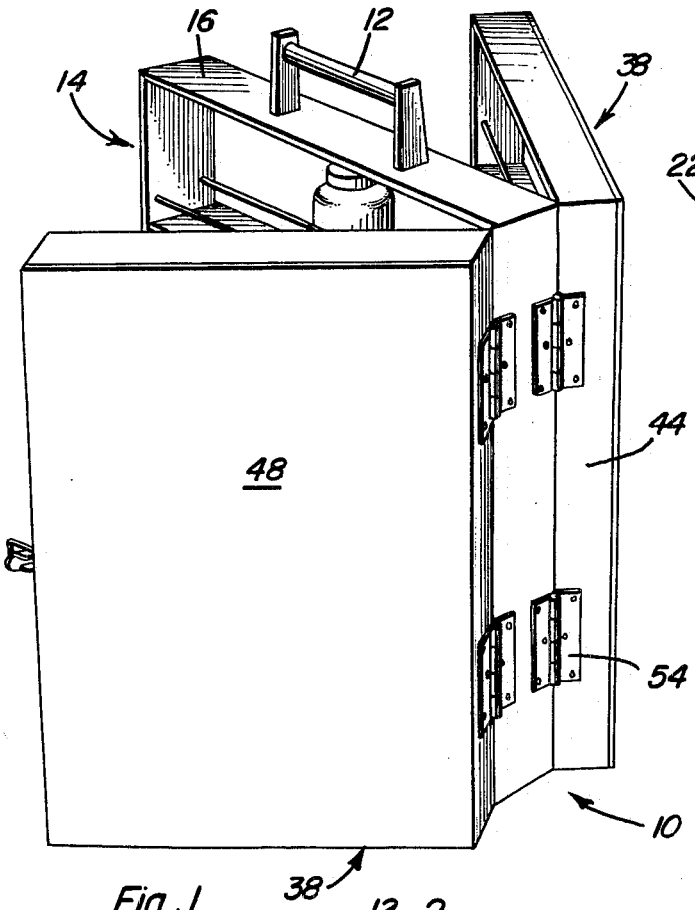
FIG. 5 is a perspective view illustrating the present storage case in an open configuration, hinged side portions of the several sections of the case being particularly shown.
Figure 2:
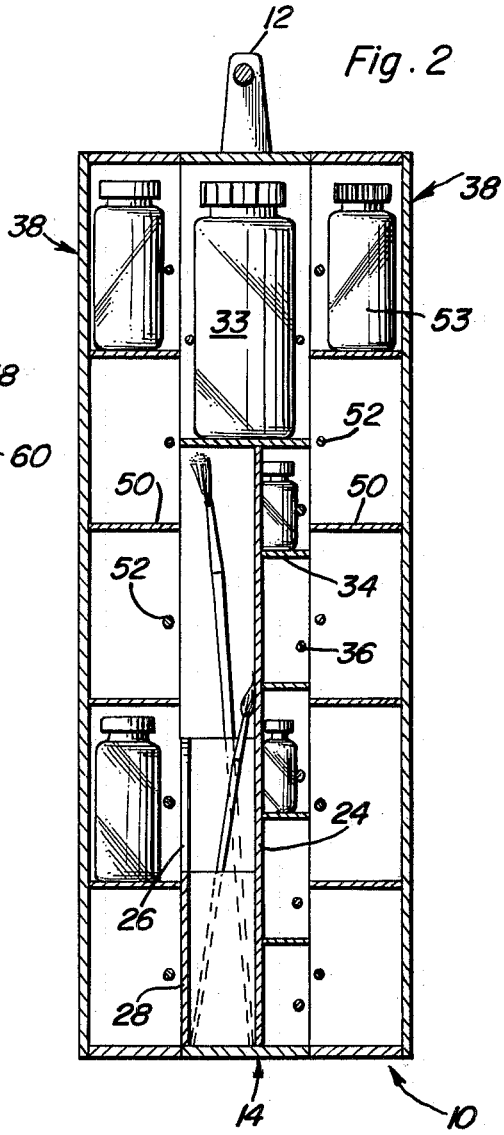
FIG. 2 is a section taken along line 2—2 of FIG. 1.

As can be seen in FIGS. 2 and 5, the closed side wall 20 of the middle section 14 and the closed side wall 44 of the side sections 38 are hinged together for relative pivotal movement therebetween by means of hinges 54 mounted to said closed side walls 20 and 44 along vertical edge portions thereof. Accordingly, the middle section 14 and side sections 38 can be pivoted relative to each other into the "open" and "closed" configurations particularly seen in FIGS. 1, 4, and 5. Latch stays 56 are mounted to the outer surface of the closed side wall 20 of the middle section 14 as particularly seen in FIGS. 1, 2, and 4. The latch stays 56 receive and engage retaining members 58 of throw latch members 60 mounted, respectively, to exterior surfaces of the open side walls 46 of the side sections 38, the throw latch members 60 being disposed substantially contiguously to and in facing relation to the latch stays 56 carried on the middle section 14 when the sections 14 and 38 are pivoted into the closed configuration as seen in FIG. 1.

The portable storage case 10 can, therefore, seen to be comprised of a middle section 14 having storage capacity for relatively large paint containers and for relatively small paint containers, an inner partition 24 dividing lower and middle portions of said middle section 14 into separate storage areas, one of said storage areas having shallow shelf members 34 and associated retaining rods 36 mounted therein while the other of said storage areas has the box dividers 26 and 28 located therein for particular containment of elongated articles of differing length. The portable storage case 10 is further seen to be comprised, therefore, of side sections 38 adapted by the hinges 54 to be pivotally movable relative to the middle section 14 to enclose said middle section 14 when the storage case 10 is to be carried by a user or stored for future use, the latch stays 56 and throw latch members 60 being used to fasten the sections 14 and 38 together at open side portions thereof to hold the sections 14 and 38 together in a volumetrically compact structure.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable storage case particularly useful for containing and displaying for use containers of materials and articles normally referred to as art supplies, the apparatus comprising:

an interior frame portion comprising spaced upper and lower perimetric walls joined at the ends thereof respectively by closed and open side walls, an inner partition member extending between the side walls and at least partially between the upper and lower perimetric walls to divide the interior frame portion with separate storage areas, vertically spaced first shelf members disposed on one side of the inner partition member, the first shelf members extending between and being mounted by the side walls of the interior frame portion, at least one retaining rod being spaced vertically from each first shelf member, rod members extending between and being mounted by the side walls to retain containers on the first shelf members, box-like dividers disposed on the other side of the inner partition member, the dividers being open at the upper ends thereof to receive articles, particularly elongated articles, a second shelf member disposed in surmounting relation to the inner partition member, the second shelf member extending between and being mounted by the side walls of said interior frame portion, and at least one second retaining rod member spaced vertically from each side of the second shelf member, the second retaining rod member extending between and being mounted by the side walls of the interior frame portion to retain containers on the second shelf member;

said frame portions disposed on either side of the interior frame portion, the side frame portion comprising spaced upper and lower perimetric walls joined at the ends thereof respectively by closed and open side walls, vertically spaced third shelf members extending between and mounted by the side walls for receiving the containers thereon, and at least one retaining rod member spaced vertically from each shelf member, the rod member extending between and being mounted by the side walls to retain the containers on the third shelf members; hinge means disposed on the closed side walls of the interior frame portion and the side frame portions respectively for holding the frame portions in pivotal relation to each other; and, latch means disposed on the open side walls of the interior frame portion and the side frame portion respectively for releasably holding the frame portions in a closed, volumetrically compact configuration for storage or manual transport of said case.

2. The portable storage case of claim 1 wherein the interior frame portion and the side frame portions are of substantially identical length and width.

3. The portable storage case of claim 2 wherein the interior frame portion is of a greater depth than the side frame portions.

4. The portable storage case of claim 3 wherein the second shelf member is of a greater width than the first and third shelf members.

5. The portable storage case of claim 1 and further comprising handle means mounted to the upper perimetric wall of the interior frame member for rendering the case conveniently portable.

6. The portable storage case of claim 1 wherein the box-like dividers are of differing heights.

* * * * *